US008790188B2

(12) United States Patent
Hatton

(10) Patent No.: US 8,790,188 B2
(45) Date of Patent: Jul. 29, 2014

(54) GOLF SWING INSTRUCTIONAL DEVICE

(71) Applicant: Stephen Hatton, Bellikon (CH)

(72) Inventor: Stephen Hatton, Bellikon (CH)

( * ) Notice: Subject to any disclaimer, the term of this patent is extended or adjusted under 35 U.S.C. 154(b) by 0 days.

(21) Appl. No.: 13/684,890

(22) Filed: Nov. 26, 2012

(65) Prior Publication Data

US 2013/0331196 A1 Dec. 12, 2013

(30) Foreign Application Priority Data

Nov. 25, 2011 (EP) ..... 11 190 775

(51) Int. Cl.
*A63B 69/36* (2006.01)

(52) U.S. Cl.
USPC ..... 473/212; 473/227

(58) Field of Classification Search
USPC ..... 473/219, 226, 227, 266, 276, 238
See application file for complete search history.

(56) References Cited

U.S. PATENT DOCUMENTS 4,145,054 A 3/1979 Stewart
5,203,568 A 4/1993 Vasquez
5,388,834 A * 2/1995 Dawson ..... 473/211
5,470,073 A 11/1995 Vasquez
5,904,624 A * 5/1999 Martinez ..... 473/212
5,976,024 A 11/1999 Marshall, Jr.
6,004,221 A * 12/1999 Thornhill ..... 473/227
6,251,025 B1 6/2001 Brock et al.
6,416,419 B1 7/2002 Foresi
6,805,640 B2 10/2004 Kim et al.
D579,068 S * 10/2008 Souders et al. ..... D21/753

FOREIGN PATENT DOCUMENTS

WO 93/22009 A1 11/1993
WO 2006/093988 A1 9/2006

* cited by examiner

*Primary Examiner* — Nini Legesse
(74) *Attorney, Agent, or Firm* — The Webb Law Firm

(57) ABSTRACT

A golf swing instructional device for training a golfer comprises an attachment portion having a first portion adapted to be positioned at the shaft of a golf club and a second portion adapted to be connected to two guide supporting elements. The first and second supporting elements have each a contact surface to be in contact with one or the other forearm of the practicing golfer. The two supporting elements are extending from the club contacting portion, wherein the first portion comprises a reception to accommodate the shaft of a golf club and fixation means to fix the first portion around the shaft of the club. The two guide supporting elements each comprise a first straight portion, a second straight portion and a bent connecting portion in-between.

17 Claims, 7 Drawing Sheets

GOLF SWING INSTRUCTIONAL DEVICE

TECHNICAL FIELD

The present invention relates to a golf swing instructional device for training a golfer, comprising an attachment portion adapted to be held to the shaft of a golf club, wherein the attachment portion is connected to two guide supporting elements, wherein the first supporting element having a contact surface to be in contact with one forearm of the practicing golfer and wherein the second supporting element having a contact surface to be in contact with the other arm of the golfer, wherein the two supporting elements are extending from the club contacting portion.

PRIOR ART

U.S. Pat. No. 5,203,568 and similar U.S. Pat. No. 5,470,073 relate both to a training aid, wherein there are two diverting branches having a U-shaped reception to be in contact with the inner portion of the forearms of the player. These receptions are brackets defining the position of the arms during the play. The original older patent relates to a putter whereas the younger patent relates to a conventional golf club. It is the aim of this teaching to maintain the practicing golfer's arms in an unalterable position. The guiding rod is to be maintained by the player along the grip of the golf club shaft.

The device according to U.S. Pat. No. 5,470,073 of these two documents comprises a contact element to be applied against the shaft and to be held against the shaft by the golfer, having a first supporting element having a contact surface to be in contact with one forearm of the practicing golfer and having a second arm with a contact surface to be in contact with the other arm of the golfer, wherein the two arms are extending from the club contacting portion.

Said device is difficult to use, since the golfer has to maintain the attachment strap against the golf club during the whole swing. In other words, even if such a portion of the device is a thin curved plate, it affects the grip of the shaft and requires predetermined curvature of said attachment strap.

U.S. Pat. No. 6,805,640 discloses a golf swing instructional device for training a golfer. There is a club holder to be attached to a golf club. Said club holder is connected to two pairs of supporting members which are intended to support the forearms of the golfer. Each pair of branches comprises two different supporting members which are articulately movable one against the other. The advantage of the flexibility of the device to be adapted in a plurality of situations is combined with a more difficult handling, since each branch comprises two articulated elements.

U.S. Pat. No. 4,145,054 discloses a further golf swing training aid, wherein a single rod is attached to a golf club shaft so that it forms a laterally spaced angularly-directed bifurcation of the shaft. During practicing; there is an angle of between 1 and 10 degrees between said rod and the club shaft. The rod is guiding one of the forearms of the player. The rod is attached to the golf club with a clamp comprising two clamping cavities for receiving the club shaft and said rod. The rod may be a straight element or it may comprise a curvature.

It is an aim of said prior art device to be out of contact with the forearms of the golfer during the back swing, down swing and follow through a properly executed golf swing and it will be in contact with the forearms of the golfer during an improperly executed golf swing. In other words it is not intended, that the user forearms touches the rod, which is to the contrary of the above mentioned prior art U.S. Pat. No. 6,805,640.

U.S. Pat. No. 6,251,025 discloses a golf training aid having a guide member to be attached to a golf club, wherein said guide member extends away from the attachment means such that when the guide member is attached to the shaft the stem angles upwardly with respect to the shaft having two different portions with the changing angle within. The aim of this device is to provide an indication during correct use when the golf club is probably gripped with the leading hand at approximately right angles to the shaft so that the tip is positioned on the radial bone side of the leading forearm of the player. In other words the important portion of said stamp is the tip.

Further devices on this field are inter alia WO 2006/093988, WO 93/22009 and U.S. Pat. No. 6,416,419 which show different proposals.

U.S. Pat. No. 5,976,024 discloses a golf swing instructional device for training a golfer, comprising an attachment portion adapted to be held to the shaft of a golf club, wherein the attachment portion is connected to two guide supporting elements, wherein the first supporting element having a contact surface to be in contact with one forearm of the practicing golfer and wherein the second supporting element having a contact surface to be in contact with the other arm of the golfer, wherein the two supporting elements are extending from the club contacting portion. The supporting elements are realized through branches ending in curved brackets extending essentially perpendicularly to the branches. The brackets are adapted to be in contact with the arms of the player.

SUMMARY OF THE INVENTION

Based on this prior art it is an aim of the invention to provide a simple to use golf instructional device which can also readily be adapted to different purposes.

Based on that prior art it is a name of the invention to provide a simpler to use playing aid, which can be more easily applied to the golf club to be trained and giving a direct feedback to the user.

This object is achieved with a golf swing instructional device according to the preamble of claim 1 having the features of the characterizing part of claim 1.

The golf swing instructional device for training a golfer according to the invention comprises an attachment portion having a first portion adapted to be positioned at the shaft of a golf club and a second portion adapted to be connected to two guide supporting elements. The first and second supporting elements have each a contact surface to be in contact with one or the other forearm of the practicing golfer. The two supporting elements are extending from the club contacting portion.

The first supporting element is in the attached position on a golf club oriented in parallel to the grip of said golf club, essentially at a same height above the club, and the second supporting element is in the attached position on a golf club oriented perpendicular to the plane as provided by the grip of said golf club. Both the first supporting element are essentially at a same height above the club.

According to a preferred embodiment the first portion comprises a reception to accommodate the shaft of a golf club and fixation means to fix the first portion around the shaft of the club. The two guide supporting elements each comprise a first straight portion, a second straight portion and a bent connecting portion in-between. The second portion comprises two further receptions to accommodate the first straight portions in an for an adjustment rotatable and then fixable manner around the longitudinal axis of the straight portions to orient the second straight portions in an angle relating to the shaft of the club. Then these portions can be positioned against the arms of the golfer. This position can be easily found and fixed for training. It can be maintained after removing and reaffixing the device to the club for further training.

One advantage of the device relies on the fact that the length and position of the two supporting elements, i.e. the arms, can be changed readily to adapt the contact surfaces against the forearms, wherein the contact surfaces are no longer brackets with straps but simple round rods at that place.

The teaching aid according to the invention is unique in providing the very position where the teaching aid is placed on the golf club. With the teaching aid placed on the golf club the golfer must swing the golf club continuously on the correct plane and in the correct positions, for the teaching aid to remain in contact with the golfers arms. Devices according to the prior art as U.S. Pat. No. 5,976,024 or U.S. Pat. No. 6,416,419 do not achieve this. At best they try to achieve one position in the golf swing. None are for the plane of the golf swing and the whole of the golf swing from beginning to the end of the golf swing. This is immediately clear when the brackets of U.S. Pat. No. 5,976,024 are studied. They abut against the arms of the player at a specific position and they cannot maintain this contact during the swing. It is the use of the branches as blocking element with their cylindrical circumference that allow the surface of the branches to remain in contact with the arms of the player. The contact surfaces of the branches are their cylindrical surfaces and not as in the case of the prior art devices brackets or other bars at the end of the branches.

For the present teaching aid, it is imperative that there is a virtual point in a radial distance from the golf club, where the branches meet. Usually this is achieved with an inclined element allowing the branches to be placed in the correct way and this includes a specific predetermined height of the elements from the very center of the golf shaft. The angle of the elements is adjusted in relation to the clubface. The length of the two elements has to be sufficient that the side surfaces of the elements are adapted to touch the forearms of the player. The mounting achieves a 90° angle between the two elements which is important.

The golfer must then swing the golf club in correct manor for the teaching aid to stay in contact with the golfer. This includes the backswing, the downswing, the moment of impact and also the finish of the golf swing. There is no teaching aid of the mentioned prior art that comes anywhere close to carrying out these functions which had been tested by golf professional including world's leading teaching professionals and players.

A golfer can improve his swing from a driver to a sand wedge with the teaching aid according to the invention attached to the club and actually hit golf shots.

The elements from the teaching aid according to the invention can and must remain in contact with the golfer's arms from the address to the finish position. This function is realized with the adapted branches wherein one is extending parallel to the golf club shaft in a predetermined distance and a second branch in a 90° angle thereto. Then the surfaces and not the end of the branches contact the players arms and can thus remain in contact over the whole swing, what cannot be reached with the playing aids according to the prior art. Since the distance of the bracket is fix and will not follow the movement of the player's arms.

Further embodiments of the invention are laid down in the dependent claims.

BRIEF DESCRIPTION OF THE DRAWINGS

Preferred embodiments of the invention are described in the following with reference to the drawings, which are for the purpose of illustrating the present preferred embodiments of the invention and not for the purpose of limiting the same. In the drawings.

DESCRIPTION OF PREFERRED EMBODIMENTS

Figure 1:
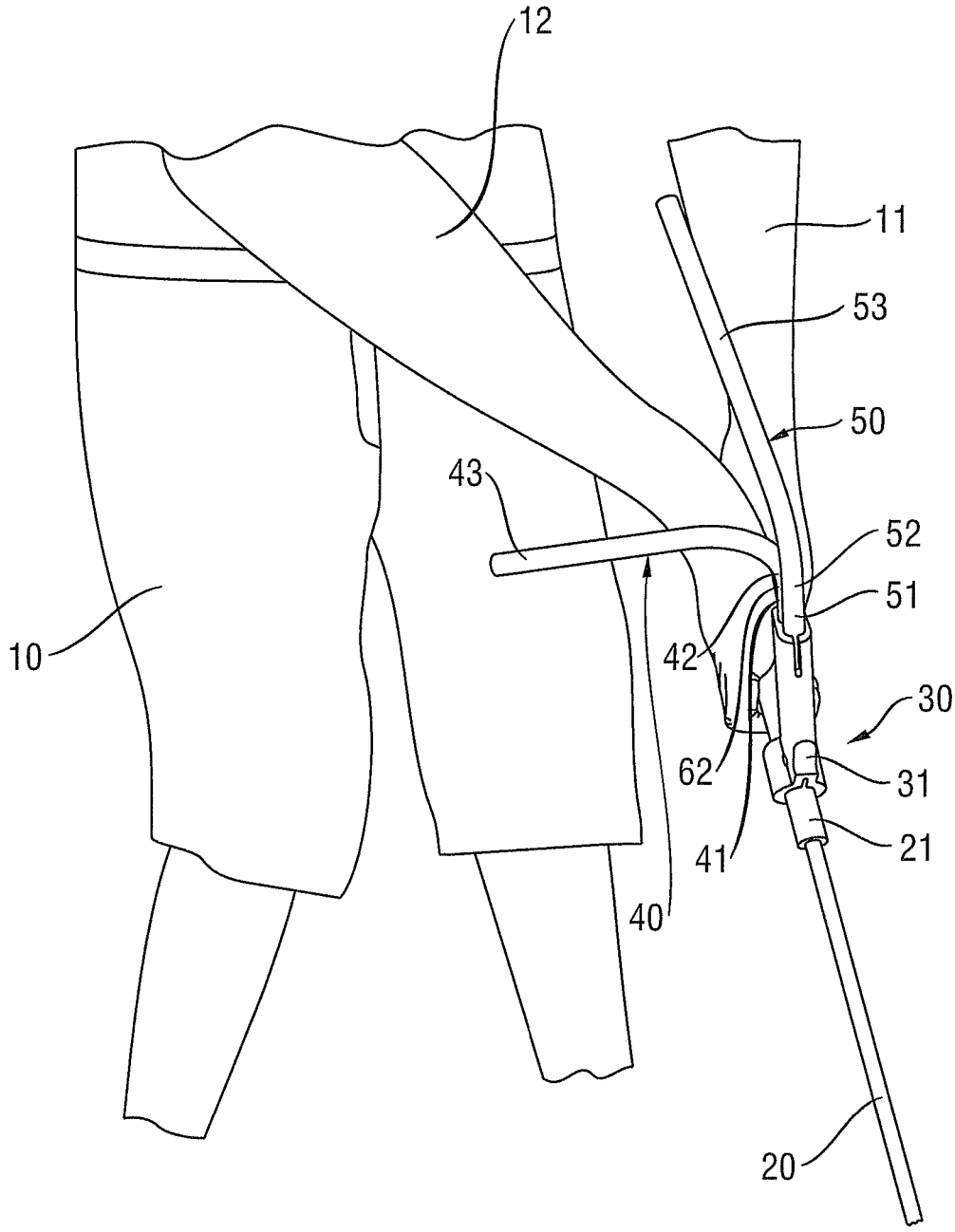
FIG. 1 shows a partial perspective view of a device according to an embodiment of the invention, attached to a golf club in the hands of a user at the impact of the ball.

FIG. 1 shows a partial perspective view of a user 10 exercising his swing with a conventional golf club 20. FIG. 1 shows the arms 11 and 12 of the user 10 wherein the user's hands are gripping the shaft 21 of the golf club 20 with a traditional grip position at grip 22. The device 30 according to an embodiment of the invention is attached on the shaft 21 of the golf club 20. The device 30 according to the invention comprises an attachment portion 31, being represented in a perspective view in FIG. 5, as well as two branches 40 and 50. The branches 40 and 50 have a free straight end 41 and 51, respectively, being lodged in respective reception portions 32 and 33 of the attachment means 31.

The two branches or arms 40 and 50 of the device are preferably made of a light weight material as an aluminum rod, being covered by a soft textile or plastic cover, e.g. a thin foam cover (not represented in the drawings). The branches 40 and 50 are several parts of connected rods and have an outer contact surface in the portions 43 and 53 being the cylindrical shell of the rods.

The first straight portion 41 of the shorter branch 40 has a length of e.g. 55 millimeter until reaching a bending portion 42, which may have a radius of between 30 and 40 millimeter to extend into a second straight portion 43 having a length of 150 millimeter. The curvature $\alpha$ between the two straight portions 41 and 43 is between 100 and 160, preferably between 130 and 150 and especially 140 degree. The longer branch or arm 50 may have a first straight portion 51 of 55 millimeter, a second straight portion 53 with a length of 240 millimeter and a reduced curvature $\beta$ of 130 to 170 and more preferably 140 to 160 and especially 150 degree. The curvature of the bending portion 52 can be identical to the first arm 40. The lengths of the first straight portions 41 and 51 of the two branches 40 and 50, respectively, are the same, since they are intended to be used as fixation elements within the attachment portion 31.

Figure 2:
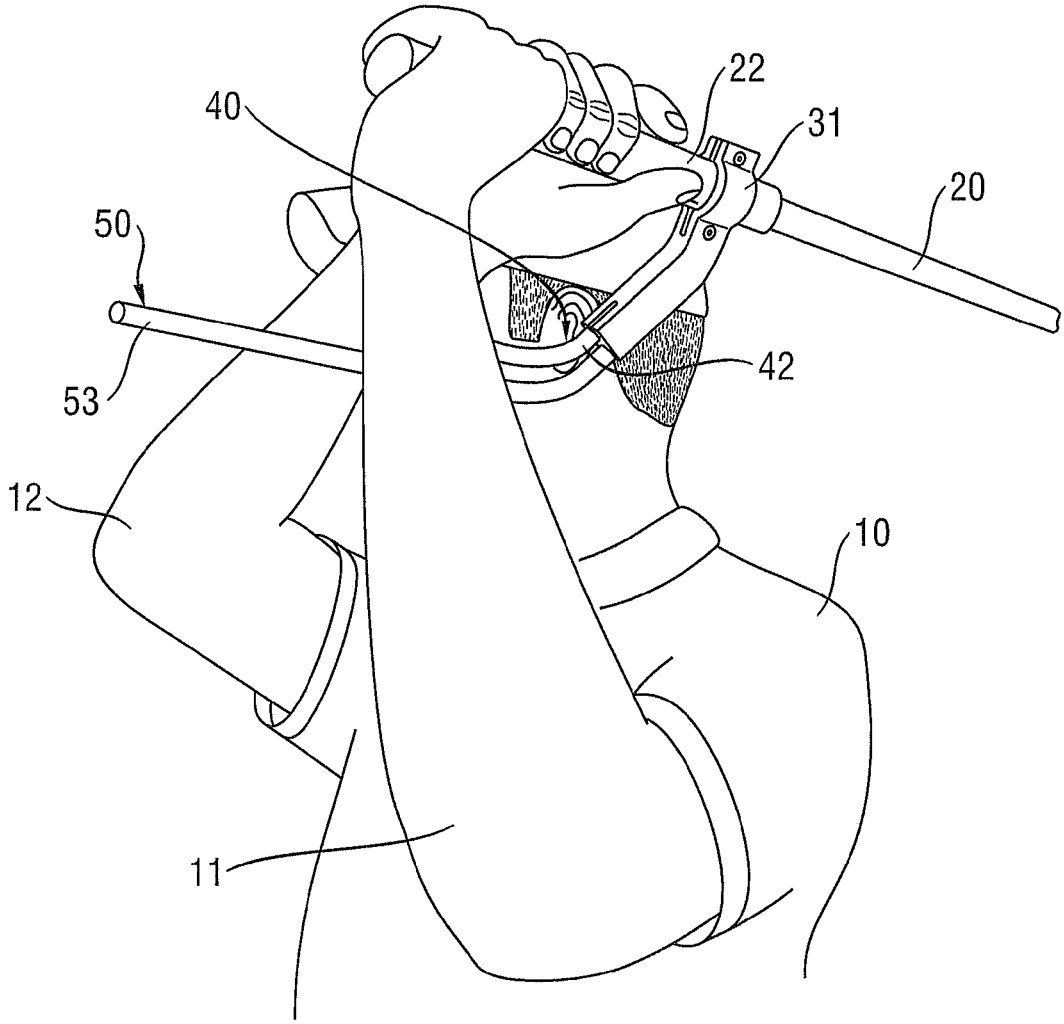
FIG. 2 shows a perspective view of the device according to FIG. 1 in the hands of a user during the finish of the swing.

FIG. 1 shows the position of the two arms 40 and 50 during the impact, where it is important that the head (not shown) of the club 20 is oriented at a right angle to the ball and this plan has to be parallel to the orientation of the branch portion 53. FIG. 2 shows the position of the two arms 40 and 50 finishing his swing. It can clearly be seen, that the shorter arm 40 extends outside of the right forearm 12 whereas the longer arm 50 is extending between the two forearms 11 and 12. As can be seen from FIG. 2, the attachment portion 30 does not hinder the golfer 10 to achieve a good grip on the shaft portion of the club 20 since the attachment portion 31 does not interfere with the users hands.

Figure 3:
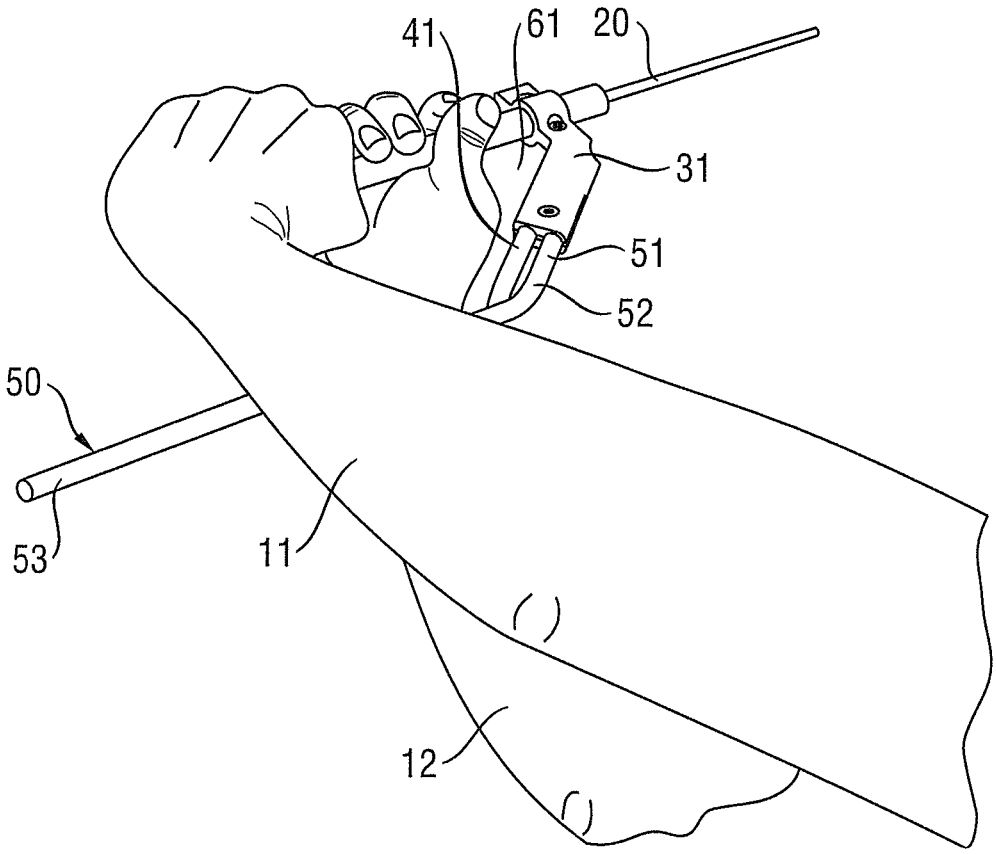
FIG. 3 shows a perspective view of the device according to FIG. 1 during the top of the backswing of the user.

FIG. 3 shows the position of the hands of the golfer above the attachment portion 31 of the device and the club 20 at the top of the backswing. Since FIG. 3 shows the golfer 20 from the left it can be seen that the longer arm 50 is below the left arm 11 of the user wherein the shorter arm 40 is covered in said drawing by the user's right arm 12.

Figure 4:
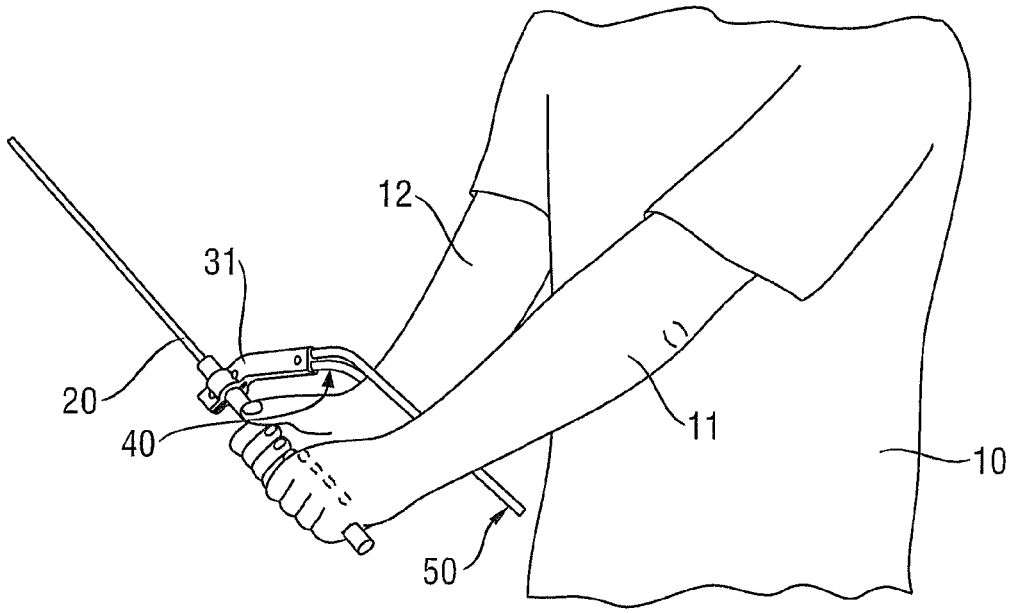
FIG. 4 shows a further perspective view of the device according to FIG. 1 during the downswing.

FIG. 4 shows a different perspective view compared to FIG. 3 wherein it can more clearly be seen that the shorter arm 40 is still in contact with the right forearm 12 from the outside.

Figure 5:
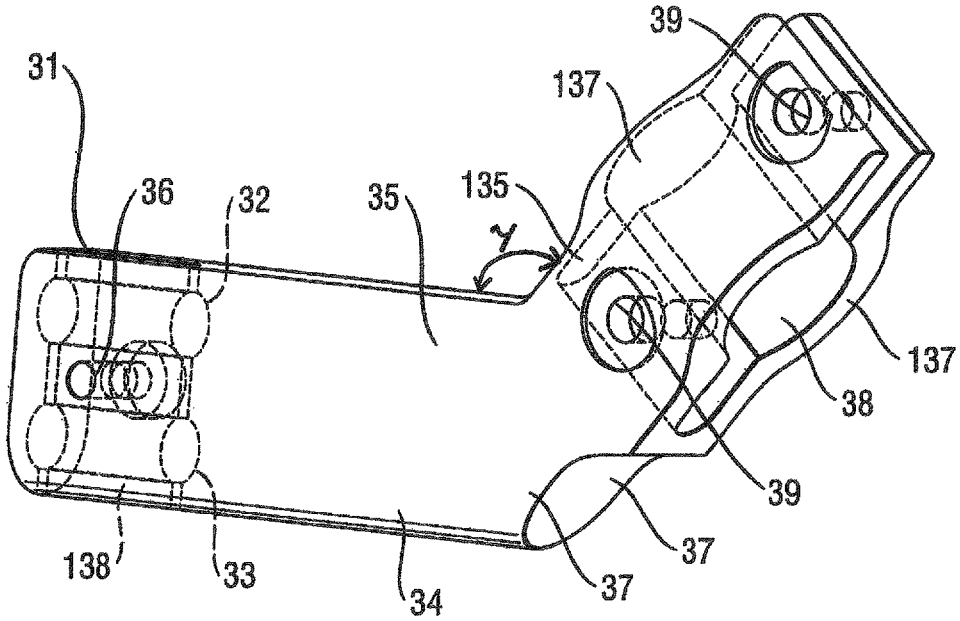
FIG. 5 shows a perspective view of the attachment clamp of the device according the embodiment of FIG. 1.

FIG. 5 shows a perspective view of the attachment element 31 of a device according to an embodiment of the invention, wherein the screws for closing the element 31 are not shown in the drawing.

The element 31 comprises a U-shaped reception portion 35 wherein the two jaws 37 are connected by a semicircular closing semi-cylinder 34. Within these jaws 37 two parallel receptions 32 and 33 are provided wherein the semi-cylindrical connection 34 comprises a slit over that length. Between the two receptions 32 and 33 a through bore 36 is provided to allow introduction of a closing screw perpendicular to the flat plans of the jaws 37, so that the two branches 40 and 50 of the device, when introduced into the parallel receptions 32 and 33, respectively, can be fixedly attached within the clamping jaws 37 of attachment means 31. In other words, through closing the clamp 35 through screwing a screw into hole 36, either in a thread in one of the holes 36 in the jaws 37 or with a nut, the two branches 40 and 50 can be fixedly attached in relationship to the attachment means 31 and in a specific angle of the longer straight portions 43 and 53, respectively, one to another as well as in predefined lengths of introduction of the shorter straight portions 41 and 51, respectively, into the attachment means 31. The length of the jaws 37 in the direction of introduction of the rods of branches 40 and 50 is preferably such, that they can be accommodated in almost their whole length within the device 31.

Said first clamping portion 35 is connected to a second clamping portion 135 having a different longitudinal axis. The two clamping jaws 137 of said second portion 135 are intended to provide a cavity 38 to accommodate the shaft of the golf club 20. On both sides of said cavity 38 through going bores 39 are provided so that through introduction of closing screws into said bores 39 the attachment device 31 can be affixed to a golf club 20. The angle $\gamma$ between the two attachment portions 35 and 135 accommodating the arms 40 and 50 in the receptions 32 and 33 as well as the shaft of the club 20 in reception 38 is chosen to be between 110 and 150 degrees, more preferably between 120 and 140 degrees, and in the present embodiment as shown of 130 degrees.

Figure 6:
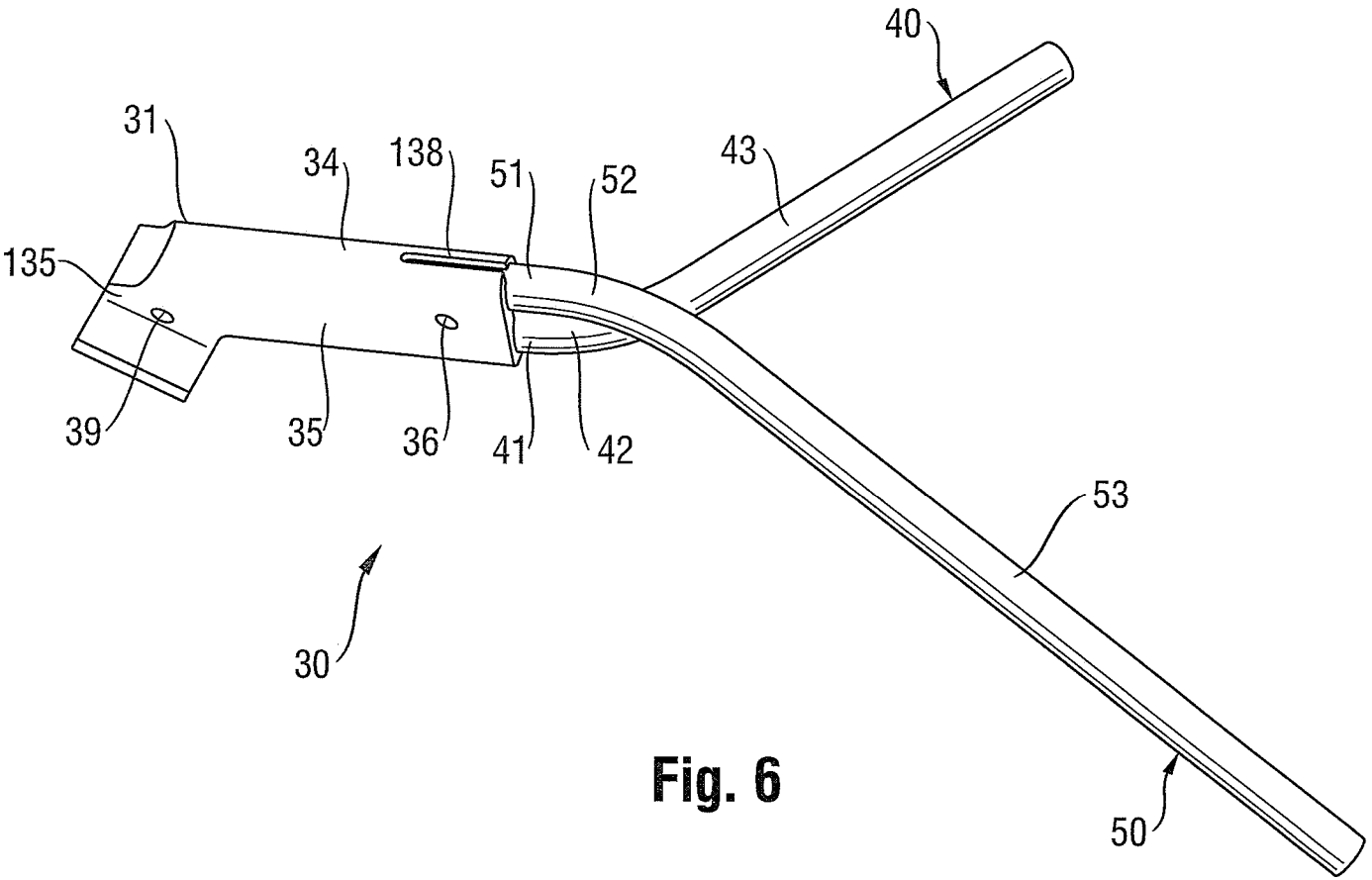
FIG. 6 shows a further perspective view of the device according to an embodiment of FIG. 1.

FIG. 6 shows a perspective view of the device wherein the two longer portions 43 and 53 of the arms 40 and 50 are forming a Y. The angle between the straight portions 43 and 53 can be chosen in the 3-dimensional space through orienting the two straight portions 43 and 53 in view of the predefined direction of the club 20 shaft through turning the branches 40 and 50 within the receptions 32 and 33 before closing the attachment portion 35.

It is well seen in FIG. 6 that a slit 138 allows for a clamping of the branches 40 and 50 in the receptions 32 and 33. Therefore it is possible to adjust the position of the arms 40 and 50 once for a specific user and then attach the training aid to a golf club 20. The device 30 can then also be removed from the club 20 without losing the orientation of the branches 40 and 50. This is due to the fact that the two fixation portions 32, 33 and 36 on one side and 38, 49 on the other side are completely independent and only connected via the jaws 37 and 137 as well as the semi-cylinder 34 and the corresponding crossing portion.

The device 30 is adapted to accompany the full swing of the golfer 10. The lead arm 11 must be positioned at a certain height from the club 20 and in complete parallel line with the middle of the shaft from the golf club 20 and at the right angle to the golf club face. The second arm 12 must also be at a certain height but is placed at an approx. 55 degrees angle to the first arm 11 of the golf club 20. When said angles of the arm in view of the golf club 20 are correct then the positioning of the longer straight portions 43 and 53 of the teaching aid 30 are in contact with the forearms 11 and 12 of the golfer 10. Then the golfer 10 will be able to swing the golf club 20 in a perfect golf swing plan which means that it is not too flat and not too steep. The golf club face which is predefined in view of the attachment portion 30 will remain square to the swing plan. It will not be too open or too closed.

The angles within the swing needed to generate power are also maintained while there is connection with the golfer and both arms from the teaching aid doing the downswing as can be seen in FIGS. 2 to 4. The golfer 10 must also make the correct length of swing, which means that it is not too short or not too long. At impact of the golf club with the ball one of the arms can remain in contact with the golfer producing the perfect impact position during the through swing, when the arms are in contact with the golfer the swing will be on plan and the club 20 remains face square to the swing plan.

Therefore in order to correctly use the device the golfer and/or the trainer uses the following method. The attachment portion 31 is attached to the shaft of the golf club 20 and fixed. Since the attachment portion 31 has two different clamping means separated by the intermediate arcuate portion the two branches 40 and 50 can be introduced into the receptions 32 and 33, when the attachment portion 31 is already affixed to the golf club 20. Then the golfer addresses the ball and at that time the longer straight portions 43 and 53 are not yet in contact with the forearms 11 and 12 of the golfer. Only when the golfer starts his swing at a certain point, the swing aid start to contact the golfer, i.e. the two arms are oriented that the longer straight portions 43 and 53 become in contact with the forearms 11 and 12 of the golfer; on the outside and in-between, respectively. Then the golfer can perform the upswing with the arms 11 and 12 remaining in contact with the straight portions 43 and 53. The same is true during the downswing.

Figure 7:
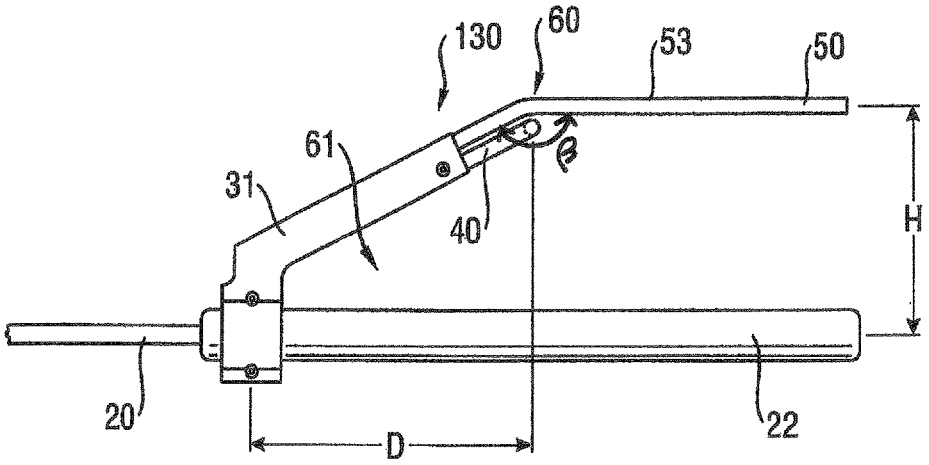
FIG. 7 shows a side-view of a further embodiment of the invention attached to a golf club.
Figure 8:
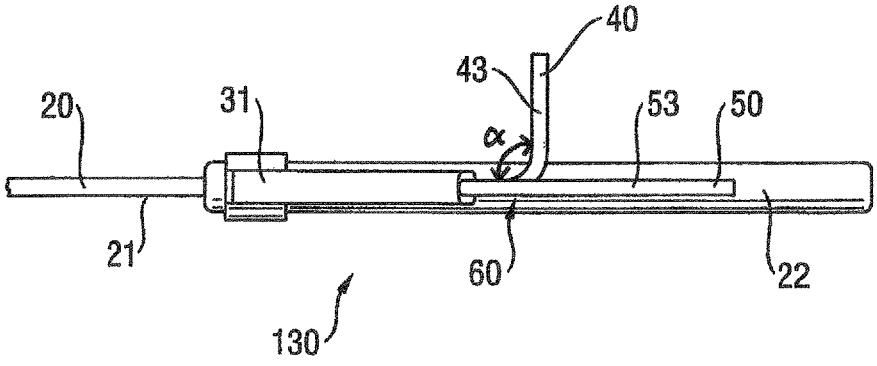
FIG. 8 shows a view from above on the device according to FIG. 7, attached to the golf club.

FIGS. 7 and 8 show a further embodiment of a golf swing instructional device 130 of the invention. FIG. 7 shows a side-view of said further embodiment of the invention attached to a golf club 20, whereas FIG. 8 shows this embodiment in a view from above. Identical or similar features have received identical or similar reference numerals.

The more schematical views of FIGS. 7 and 8 show preferred values for the orientation of the elements 31, 40 and 50 of the golf swing instructional device 130. It can be seen that the second straight portion 53 of the longer branch 50 is oriented parallel to the grip 22 of the club 20 in distance H allowing the player to accommodate his hand in the space between grip 22, attachment 31 and branch 50. It can further be seen from FIG. 8 that the second straight portion 53 of the longer branch 50 is parallel to the grip 22. The deviation from the parallel orientation in the height H can be chosen between plus and minus 5 degrees, since it is important that the second straight portion 53 is oriented in a way that it guides the forearm of the player parallel to the grip 22 of the club 20 which is especially achieved with the in-line orientation of branch 53 over grip 22 as in FIG. 8.

The second straight portion 43 of the shorter branch 40 is also oriented perpendicular to the grip 22 of the club 20. The embodiment of FIGS. 7 and 8 comprises two separate branches 40 and 50 so that the free arm 43 is positioned below the corresponding free arm 53. The difference is chosen small and in further embodiments the arms 40 and 50 can be made in one piece, providing a L-shaped guiding branch (consisting of branches 43 and 53) joining near wrist point 60. Said point 60 is at height H above the grip 22 and in a distance D from the attachment point. This allows to accommodate the hands of the user in the triangular space 61; especially the bottom of the V-shaped connection 62 between thumb and index finger of the right hand (in the embodiment of FIG. 1 for a right-hander) just between the metacarpals and carpals of these two fingers is located below point 60.

Height H is usually between 8 and 15 centimeters. Length D is usually between 5 and 20 centimeters; although it is only the lower length which has a minimum value to provide the accommodation space 61.

In an embodiment with lesser parts, the attachment portion 31 can be provided with one piece together with the longer branches 53 and 43 of arms 50 and 40, respectively, when the two parallel relationships between the device and the grip 22 in a affixed position are maintained as long as the two branches 53 and 43 are at a right angle one to the other, wherein the angle of the attachment portion 31 is adapted to accommodate the hand of the user within the triangular space 61.

The arm of the player contacts the two branches 53 and 43 on their sides. Therefore the free ends of the branches 40 and 50 are long enough to extend beyond the side contact surface of the arms of the golfer. Therefore the abutment surface for the arm of the golfer is not formed at the end of the branch, e.g. as with a bracket as disclosed in U.S. Pat. No. 5,976,024, but provided as the major portion of the side surface of the branches 50 and 40. Thus there is a gliding movement possible following the long of the branch 50 or 40, respectively, when a whole swing is executed. This continuous contact is achieved providing the branches 53 and 43 from the starting point 60 in a predetermined height H from the shaft, allowing the hand of the player to be lodged in the triangle within the distance D of the attachment of the device on the club.

In other embodiments, it is possible, e.g. to provide a specially adapted bunker wedge aid, which needs an open club face, to have a longer branch 53 of element 50 which is curved towards the shaft 22 beyond a predetermined length of branch 3, i.e. beyond a distance of D from the point 60.

LIST OF REFERENCE SIGNS

| | |
|---|---|
| 10 | user |
| 11 | left arm of the user |
| 12 | right arm of the user |
| 20 | golf club |
| 21 | shaft |
| 22 | grip |
| 30 | training device |
| 31 | attachment portion |
| 32 | reception |
| 33 | reception |
| 34 | semi-cylinder |
| 35 | reception/clamping portion |
| 36 | through bore |
| 37 | jaw |
| 38 | cavity for golf club shaft |
| 39 | through bore |
| 40 | shorter branch |
| 41 | first straight portion |
| 42 | bending portion |
| 43 | second straight portion |
| 50 | longer branch |
| 51 | first straight portion |
| 52 | bending portion |
| 53 | second straight portion |
| 60 | wrist point |
| 61 | triangular space |
| 62 | V-portion of a user's hand |
| 135 | second clamping portion |
| 137 | clamping jaw |
| 138 | slit |

The invention claimed is:

1. A golf swing instructional device for training a golfer, comprising a first and a second arm guide supporting element, and an attachment portion having a first portion adapted to be positioned at the shaft of a golf club, and a second portion adapted to receive the two arm guide supporting elements;

wherein the two arm guide supporting elements extend from the attachment portion contacting the club, wherein the first arm guide supporting element has a contact surface configured for contact with one forearm of the practicing golfer and wherein the second arm guide supporting element has a contact surface configured for contact with the other forearm of the golfer, wherein the first arm guide supporting element is, in the attached position on a golf club, positioned parallel to a grip of said golf club, essentially at a predetermined constant height above said golf club, wherein the second arm guide supporting element is, in the attached position on a golf club, oriented perpendicular to the grip of said golf club and the first arm guide supporting element, and is essentially at the same predetermined constant height above said golf club.

2. The golf swing instructional device according to claim 1, wherein the two arm guide supporting elements are made in one piece and wherein the two arm guide supporting elements are formed at a right angle relative to one another.

3. The golf swing instructional device according to claim 2, wherein the two arm guide supporting elements create a triangular space between the grip and the attachment portion adapted to accommodate the hand of a user, wherein the triangular space defines an angle between the grip and the attachment portion, wherein the angle is chosen to allow the positioning of a junction between the thumb and the index finger of the hand of a golfer using the device below the two arm guide supporting elements.

4. The golf swing instructional device according to claim 1, wherein the first portion of the attachment portion comprises an aperture to receive the shaft of a golf club and a means for fixing the first portion of the attachment portion around the shaft of the golf club, wherein the two arm guide supporting elements each comprise a first straight portion, a second straight portion and a bent connecting portion in-between, and wherein the second portion of the attachment portion comprises two apertures to receive the first straight portions of the two arm guide supporting elements, wherein the first straight portions of the two arm guide supporting elements can be rotatably adjusted and then fixed around the longitudinal axis of the first straight portions to orient the second straight portions in an angle relative to the shaft of the golf club.

5. The golf swing instructional device according to claim 4, wherein the first portion and the second portion of the attachment portion are positioned relative to one another at an angle between 110 and 150 degrees.

6. The golf swing instructional device according to claim 5, wherein the first portion and the second portion of the attachment portion are positioned relative to one another at an angle between 130 and 140 degrees.

7. The golf swing instructional device according to claim 4, wherein a radius of curvature of the bent connecting portion and the length of the first straight portions of the two arm guide supporting elements are essentially equal one to another.

8. The golf swing instructional device according to claim 1, wherein a length of the second portion of the attachment portion is at least as long as a length of the first straight portions of the two arm guide supporting elements.

9. The golf swing instructional device according to claim 1, wherein a length of each second straight portion of the two arm guide supporting elements are essentially different one to another.

10. The golf swing instructional device according to claim 1, wherein an angle of the bent connecting portion of the arm guide supporting elements is between 130 to 170 degrees.

11. The golf swing instructional device according to claim 1, wherein an angle of the bent connecting portion of the arm guide supporting elements is between 140 to 160 degrees.

12. The golf swing instructional device according to claim 1, wherein the two arm guide supporting elements are rods.

13. The golf swing instructional device according to claim 12, wherein the two arm guide supporting elements are hollow rods.

14. The golf swing instructional device according to claim 12, wherein the second straight portions of the two arm guide supporting elements are covered by a flexible contact foam.

15. The golf swing instructional device according to claim 1, wherein the arm guide supporting elements and the club shaft are fixed within the apertures of the attachment portion with a friction lock connection, especially a screw-thread combination.

16. The golf swing instructional device according to claim 15, wherein the friction lock connection is a screw-thread combination.

17. The golf swing instructional device according to claim 1, wherein the first portion and the second portion of the attachment portion have different pairs of jaws wherein the first portion and the second portion are connected via a connecting portion.

* * * * *